US005377714A

United States Patent [19]

Giannesini et al.

[11] Patent Number: 5,377,714

[45] Date of Patent: Jan. 3, 1995

[54] DEVICE AND METHOD FOR TRANSFERRING A MULTIPHASE TYPE EFFLUENT IN A SINGLE PIPE

[75] Inventors: Jean-François Giannesini, Saint Cloud; Emile Levallois, Courbevoie, both of France

[73] Assignee: Institut Francais du Petrole, Rueil Malmaison, France

[21] Appl. No.: 174,279

[22] Filed: Dec. 28, 1993

[30] Foreign Application Priority Data

Dec. 29, 1992 [FR] France ..... 92 15984

[51] Int. Cl.[6] ..... F04D 25/16; F04D 31/00

[52] U.S. Cl. ..... 137/2; 137/110; 137/173

[58] Field of Search ..... 137/2, 110, 173

[56] References Cited

U.S. PATENT DOCUMENTS 5,049,823 9/1991 Castel et al. ..... 324/640
5,254,292 10/1993 Gabryelczyk et al. ..... 261/76

FOREIGN PATENT DOCUMENTS 2424472 11/1979 France .
2424473 11/1979 France .
2647549 11/1990 France .
2665224 1/1992 France .
2014862 9/1979 United Kingdom .
2239193 6/1991 United Kingdom .
2239676 7/1991 United Kingdom .
9008585 8/1990 WIPO .

*Primary Examiner*—Robert G. Nilson
*Attorney, Agent, or Firm*—Antonelli, Terry, Stout & Kraus

[57] ABSTRACT

The present invention relates to a method for transferring a multiphase effluent whatever the value of its gas phase/liquid phase volumetric ratio GLR may be. The value of the GLR is determined by means of a measuring device D, before it reaches a separation tank, when the measured value of the GLR is greater than a boundary value, part of the gas phase is discharged through compression means in connection with the tank, as long as the level of the liquid-gas interface in the tank is below a threshold value.

17 Claims, 1 Drawing Sheet

DEVICE AND METHOD FOR TRANSFERRING A MULTIPHASE TYPE EFFLUENT IN A SINGLE PIPE

FIELD OF THE INVENTION

The present invention relates to a method and to a device for transferring a fluid consisting of several phases or multiphase fluid in a single pipe.

The invention is particularly well suited for transferring petroleum effluents containing in most cases at least a gas phase and at least a liquid phase, and in some cases solid particles.

BACKGROUND OF THE INVENTION

Flowing multiphase effluents in a single pipe is of high industrial importance since it allows effluent conveyance installations to be simplified by using a minimum number of pipes and investments to be minimized. The problem posed during the conveyance of multiphase fluids is due to the presence of a gas phase and of a liquid phase which display a different behaviour when pressure is communicated thereto.

Many methods are currently used for the transportation of such fluids.

The most simple method consists in separating the two phases and in raising their pressure separately before transferring them into different pipes. This method entails relatively high production costs.

The devices and methods described in patents FR-2,424,472 and FR-2,424,473 filed by the applicant allow the constituents of a two-phase fluid to be conveyed in a single pipe. These patents teach to dissolve the near total of free gas in the liquid in order to obtain a fluid only made up of liquid, so that it may be processed by the pumping means. This leads to very high costs since the gas phase has to be entirely dissolved.

Another procedure consists in using pumps designed for communicating to the multiphase fluids a pressure value providing their transfer over a certain distance. However, most of these pumps, if not all of them, are adapted for transferring effluents having a GLR value contained in a definite interval. To remedy this limitation, devices are used for controlling the effluents located upstream from the pump, which allow an effluent whose GLR value is compatible with the working characteristics of the pump to be delivered thereto. The GLR ratio is defined as the ratio of the gas phase to the liquid phase (Gas/Liquid Ratio).

However, devices of this type have working limitations, notably when the GLR ratio variations are too sudden, for example when too great an amount of gas with respect to the processing capacity of the pump reaches the pump inlet, this amount of gas being called a "gas pocket".

Within the scope of the current development of multiphase fluid transportation, it is increasingly important to have a method and a device allowing multiphase fluids to be transferred in a single pipe, whatever the value and the variation with time of their GLR ratio when leaving the well.

The composition of such an effluent may for example have successively the form of a gas pocket, of liquid plugs (GLR=0), or of an effluent whose (gaseous phase)/(liquid phase) ratio value GLR ranges between zero and a value corresponding to a gas pocket for example.

SUMMARY OF THE INVENTION

The present invention remedies the drawbacks mentioned above by using a method and a device for transferring a multiphase fluid, i.e. a fluid consisting of several phases, in a single pipe, whatever the value and the time variation of the volumetric ratio of the gas phase and of the liquid phase of this fluid may be.

Another advantage of the present invention is to suppress the variable-speed drive usually associated with the pumps and to run the pumps notably with only two rotating speeds.

In the present invention, what is understood to be an interface may refer to tan average gaseous phase/liquid phase surface. In fact, there may be a zone, in the multiphase mixtures contained in tanks, where the distinction between the liquid phase and the gaseous phase is vague notably because of the presence of foam.

The method according to the invention allows a fluid to be transferred from a source of fluid or of effluents to a point of destination inside a single pipe, this fluid consisting of at least a liquid phase and at least a gaseous phase, the composition of the fluid being expressed at any time by the value of the volumetric ratio GLR of the gaseous phase to the liquid phase, by using pumping means adapted for communicating to the fluid a sufficient pressure to provide the transfer thereof to the point of destination as long as the value of the volumetric ratio is less than a predetermined threshold value.

The method comprises:

determining the GLR value of the fluid, diverting a fraction at least of the gas phase towards compression means for communicating to said fraction a sufficient pressure necessary for its transfer, as long as the value of the volumetric ratio GLR is greater than said threshold value $V_s$, and recombining the near total of the suitably compressed gas phase with the fluid coming from the pumping means, and conveying the whole made up of the gaseous phase and of the fluid through a single pipe towards said point of destination, the whole of the recombined fluid containing at least a gaseous part.

For a fluid with a GLR value ranging between the threshold value $V_s$ and a safety value $V_r$, a fraction at least of the gaseous phase is diverted through the compression means as long as the GLR value is outside an interval ranging around the safety value $V_r$.

A compressor is for example used to raise the pressure of the gaseous phase and this compressor is started up according to the measured GLR value.

A multiphase type pump adapted for raising the pressure of said fluid having a GLR value less than the threshold value $V_s$ may be used, and the start-up thereof is controlled from the measured GLR value.

The rotating speed of the pump may be selected according to the GLR value of the fluid determined at the pump inlet.

It is possible to use a device for separating the fluid into several fractions, delivering to the pumping means a fluid whose GLR value is controlled, this value being relatively constant, or substantially zero, the device being provided with means for measuring the level of the liquid-gas interface.

The compressor is started up for example according to the measured GLR value and at least a fraction of the gaseous phase is discharged through the compressor as long as the level of the liquid-gas interface is below a threshold level value $N_s$.

For a measured GLR value ranging between the threshold value $V_s$ and a safety value $V_r$, the gaseous phase of the fluid is discharged through the compression means as long as the level of the liquid-gas interface is outside an interval ranging around the safety level value $N_r$.

The rotating speed of the pump for transferring a fluid whose GLR value at the pump inlet is more or less equal to the GLR value set by said device or substantially zero may be adjusted.

The present invention further relates to a device for transferring a fluid from a source of fluid or of effluents to a point of destination in a single pipe, this fluid containing at least a liquid phase and at least a gaseous phase, the composition of the fluid at any time being expressed by the value of the volumetric ratio GLR of the gaseous phase to the liquid phase, including pumping means adapted for communicating to said fluid a sufficient pressure for transferring it to a point of destination as long as the value of the volumetric ratio is less than a predetermined threshold value $V_s$, means for orienting and separating the fluid according to its GLR value, including at least two discharge lines, one for diverting part of the gaseous fraction of the fluid and the other for diverting a part of the fluid whose GLR value is controlled. It comprises:

means for measuring the GLR value of the fluid, compression means connected to one of the discharge lines, orientation means adapted for communicating to at least one part of the gaseous fraction a sufficient pressure to transfer it as long as the GLR value of the fluid is greater than the threshold value, and a device connected to the pumping means and to the compression means for recombining the near total of the suitably compressed gaseous phase with the fluid coming from the pumping means with no complete dissolution of one phase in the other, the mixture obtained thereby being transferred through a single pipe towards said point of destination, said mixture containing at least a gas phase.

The pumping means include for example a multiphase pump.

The means for compressing the gaseous phase may include a compressor.

The means for orienting and for separating the fluid according to its GLR value may include a tank crossed by a first tube pierced with a plurality of ports located in its upper part and by a second concentric tube located outside the first tube and pierced with ports located in its lower part, the height of the second tube being less than the height of the first tube.

In this case, the tank is for example provided with a level detector for measuring the level of the liquid-gas interface.

The device may be provided with means for adjusting the rotating speed of the pump.

The method and the device according to the invention are notably applied to the transfer of a multiphase petroleum effluent containing at least a liquid phase and at least a gaseous phase, or to the transfer of a petroleum effluent mainly consisting of a gaseous phase.

BRIEF DESCRIPTION OF THE DRAWINGS

Other features and advantages of the present invention will be clear from reading the description hereafter, with reference to the accompanying drawings in which.

DESCRIPTION OF THE PREFERRED EMBODIMENTS

The device described hereafter allows the transfer, in a single pipe, of a fluid containing at least a liquid phase and at least a gaseous phase, whatever the value and the variation of the volumetric ratio GLR of this fluid may be. The binomial running of a multiphase pump, for example, and of a compressor is used to that effect. The compressor starts up when the GLR value of the fluid to be processed becomes greater than the boundary GLR value compatible with the running of the pump and compresses a fraction or gaseous phase of the fluid until the volumetric ratio GLR of the gaseous phase to the liquid phase of the fluid reaches a given value.

Figure 1:
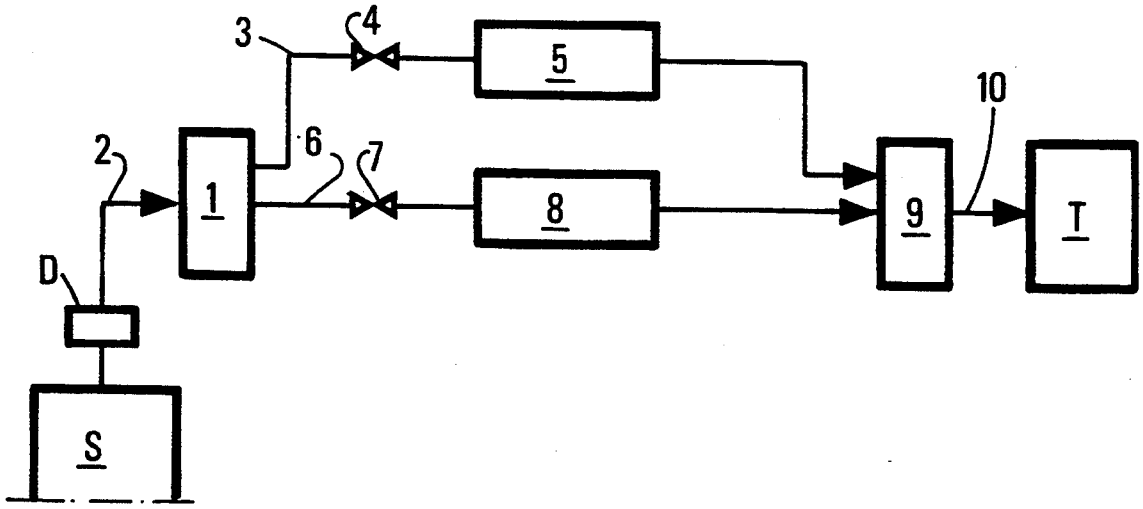
FIG. 1 is the block diagram of the device according to the invention.

The fluid or multiphase effluent is conveyed (FIG. 1) from a source of effluents S towards fluid orientation and separation means 1 through a line 2 or supply line provided with a means D for measuring the GLR value. Means 1 consist for example of a device capable of orienting the effluent totally or partly according to its GLR value towards two compression circuits. One of the circuits includes a line 3 provided with a valve 4 and with means for compressing a fluid mainly consisting of a gaseous phase, such as a compressor 5, and the other is a circuit adapted for compressing a fluid having a given GLR value and including a line 6 provided with a valve 7 and with a pump 8. The various compressed fluid fractions coming from lines 3, 4 are gathered in a single pipe 9, possibly by means of a mixer 10, before being transferred towards a point of destination T such as an effluent processing or storage station.

Compressor 5 is for example a wet compressor such as a screw compressor well-known to the man skilled in the art.

Pump 8 is preferably a multiphase type pump such as that described in patent application FR-2,665,224 filed by the applicant, adapted for conveying effluents whose GLR value lies within a given variation interval and, besides, capable of conveying effluents mainly consisting of a liquid phase.

Figure 2:
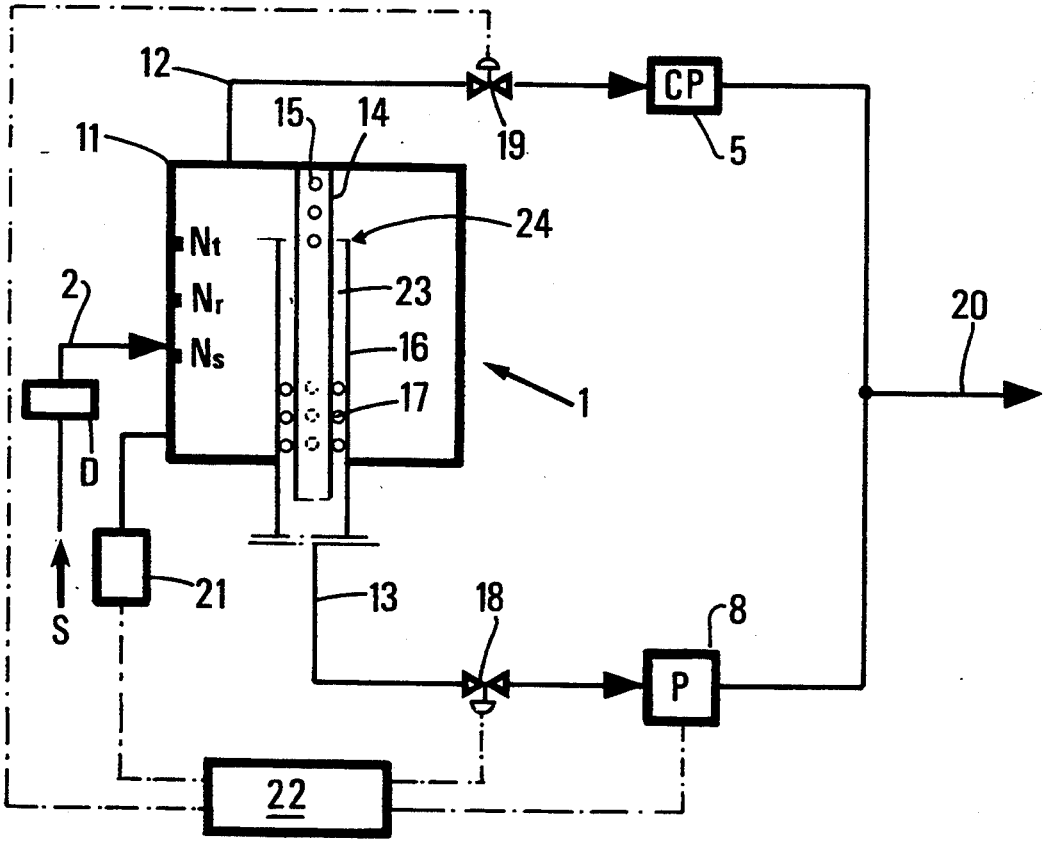
FIG.2 shows an embodiment example of the invention consisting of a compression circuit including a compressor, a second circuit including a multiphase pump and an effluent control device.

According to a preferred embodiment schematized in FIG. 2, the device according to the invention includes in association a multiphase pump (P 8), a compressor (CP 5), and the previous device D for measuring the GLR value, the orientation and separation means 1 consisting here of a surge drum or regulating drum T.

Apart from the particular case when large gas pockets or liquid plugs appear, regulating drum 1 is adapted for damping the GLR variations of the effluents. It delivers, at the inlet of pump 8, effluents having a GLR value maintained within a reduced variation range.

The characteristics of the regulating drum are notably determined according to the source of effluents.

This embodiment is particularly well suited to the transfer of a multiphase fluid such as a petroleum effluent consisting of at least a gaseous phase and at least a liquid phase, the proportions of these two phases varying with time unpredictably.

Surge drum 1 receiving the effluent coming from source S includes a tank 11 fitted with a by-pass line 12 for diverting the gaseous phase of the effluent, which opens into its upper part, and with an effluent discharge line 13 in its lower part. Tank 11 is further equipped with a first sample tube 14 crossing the tank and including on at least part of its upper part sample ports 15, and with a second sample tube 16 with a greater diameter than tube 14 and located outside the first tube. The second sample tube 16 is provided with sample ports 17 preferably located in its lower part. The height of the second sample tube is less than the height of the first tube so as not to obstruct the sample ports 15 located in the upper part of the first tube 14.

Sample tube 16 is connected to the multiphase pump 8 by means of the discharge line 13 equipped with a device for insulating the tank from the pump, such as a valve 18.

Sample tube 14 is connected to compressor 5 by means of a line 12 equipped with a valve 19 allowing the compressor to be insulated from the rest of the device. The ports located in the upper part of this tube 14 are more particularly, but not necessarily, intended for drawing off the gaseous phase.

Lines 12 and 13 gather downstream from pump 8 and compressor 5 into a single pipe 20 allowing the effluent to be transferred towards a point of destination such as a processing or a storage station. After gathering in pipe 20, the effluent generally contains a gaseous phase.

A device known to specialists and adapted for recombining the gaseous phase and the liquid phase before transferring them through the pipe towards the processing station may be possibly interposed.

A device 21 allows the level of the liquid-gas interface in the tank to be measured, this measurement being used to control the evolution of the process as described hereunder.

This device 21 may for example include two differential pressure detectors located inside the regulating drum.

The device further includes control and processing means 22 such as a programmed processor for example for interpreting the data received and, according to these data, for adjusting the rotating speed of the pump, controlling the opening and the closing of the valves outfitting the lines, and the stopping of the compressor and/or of the pump if necessary. The processor is connected to the various elements of the device involved in the process according to the invention in a way known to specialists.

In some cases, it is preferable not to stop the compressor. A by-pass circuit or recycling loop (not shown in the figure) is therefore used, which allows a certain amount of gas to be continuously re-injected at the inlet of the compressor when valve 19 is shut.

The distribution and the number of the sample ports located on tubes 14 and 16 are determined according to the characteristics of the effluent of the well located upstream from the tank so as to deliver to the pump a fluid whose GLR value is controlled.

The surge drum T is dimensioned for example by means of the method described in patent application FR-91/16,231, so as to keep the GLR value of the effluent at the pump inlet substantially equal to a determined value $V_s$ for which the pump is adapted for communicating to the effluents a sufficient pressure value to provide their transfer towards a point of destination.

A possible procedure for implementing the method for transferring the effluents according to the invention is described hereafter:

A threshold value $V_s$ corresponding to a threshold level $N_s$ of the regulating dream is first determined and stored in processor 22. A second value, called a safety value and corresponding to a safety level $N_r$ of regulating drum T, whose advantage is described hereafter, and a GLR value $V_A$ corresponding to an alarm value, may also be stored.

The following stages are carried out thereafter:

The value $V_{mes}$ of the GLR of the effluent coming from the source is measured by means of device D before it enters the regulating drum. A device such as that described in patent FR-2,647,549 filed by the applicant may be used. Processor 22 compares the value $V_{mes}$ with the previously defined value $V_s$ In case $V_{mes} > V_s$, processor 22 controls the start-up of compressor 5 and the opening of valve 19, these operations being preferably achieved simultaneously. The mainly gaseous effluent is discharged through line 12, passes through compressor 5 which communicates thereto a pressure value adapted to its transfer, and is then conveyed towards transfer pipe 20 in which it is possibly recombined with other effluent fractions coming from other lines. The discharge of the gaseous phase through compressor 5 lasts as long as the value of the level N of the liquid-gas interface, measured by detector 21 and permanently controlled in the regulating drum by processor 22, is less than the value of threshold level $N_d$. As soon as the value of the interface level reaches the value $N_s$ or a near value, processor 22 controls the closing of valve 19 and the stopping of the compressor if necessary.

This diversion of the gas pocket is essential in practice only in case of a gas afflux in the form of a plug because, in most cases, the regulating drum fulfils perfectly its purpose and delivers to the pump an effluent whose GLR value is controlled and whose value is near to $V_s$. The liquid phase of the effluent passes through ports 17 and the gaseous phase passes through ports 15, the whole of the phases being transferred towards pump 8 through line 13. Pump 8 communicates to the effluent a sufficient pressure value for transferring it towards its point of destination by means of pipe 20.

In order to make the operation control of the device according to the invention more precise, one tries to keep the level N of the measured liquid-gas interface in the regulating drum within an interval ranging around the safety value $N_r$. The effluent is therefore discharged partly through compressor 5 and partly through pump 8 when the level N of the liquid-gas interface ranges between $N_s$ and $N_r$.

Discharge of part of the gaseous phase of the effluent through compressor 5 causes the level N of the liquid-gas interface to rise towards the safety level $N_r$.

To that effect, processor 22 controls the opening of the two valves 18 and 19 and, if need be, the start-up of pump 8 and of compressor 5. By measuring the level N of the liquid-gas interface in the surge drum permanently, it checks the variation of this level and controls the closing of valve 19 and the stopping of the compressor as soon as value N approaches or equals the safety value $N_r$.

The pump and/or compressor start controls depend on the previous condition.

As long as the GLR value of the effluent is near to the safety value $N_r$, the processor leaves the system in or sets it to a normal working condition again for which compressor 5 is stopped, valve 19 is shut, valve 18 is open and pump 8 is working.

In another embodiment, the device, in case of appearance of gas pockets of high value, allows the pump to be stopped.

After determining the value $V_{mes}$ of the GLR of the effluent, processor 22 compares this value to the value $V_A$ corresponding to an alarm value $V_A$ defined for example by the following ratio: 95% gas and 5% liquid.

If $V_{mes} > V_A$, the processor controls the stopping of pump 8, the closing of valve 18, the start-up of compressor 5 and the opening of valve 19.

The effluent is discharged through line 12 similarly to the description above until the measured interface level reaches or approaches the threshold value $N_s$.

The method according to the invention also allows the variable-speed drive of the pump to be suppressed and the pump to be preferably run with two possible speed values $R_1$ and $R_2$.

Value $R_1$ is defined as the normal operation value of the pump.

When a liquid plug enters the tank, it is recommended to change the rotating speed of the pump in order to optimize the running of the pump and to pass over to a value $R_2$ suited for transferring an effluent mainly consisting of liquid.

This speed adjustment stage is for example achieved as follows.

The liquid plug entering tank 11 causes the level of the liquid phase to rise. When the liquid reaches the upper edge 24 of tube 16, the oil flows at the same time through the ports 17 of tube 16 and into the annulus 23 formed by the outer wall of tube 14 and the inner wall of tube 16. The upper edge of tube 16 is marked by a level Nt with respect to tank 11. Since the processor monitors permanently the value of the liquid-gas interface, as soon as the value of the measured interface level N exceeds the value Nt, the processor acts upon the rotating speed of the pump to pass it from value $R_1$ to value $R_2$.

The values of the threshold level $N_s$ and of the safety level $N_r$ are calculated according to the characteristics of the pump included in the compression circuit.

Without departing from the scope of the invention, the GLR value may also be measured by means of any device capable of determining the value of the ratio of the gas phases to the liquid phases present in the effluent.

Any types of pumps or compressors adapted for communicating a given compression value to the fluids may also be used without departing from the scope of the invention.

Similarly, any types of motors whose speed is preferably adjustable may be used.

Of course, the method and the device which have been described by way of non limitative examples may be provided with any modifications and/or additions by the man skilled in the art without departing from the scope of the invention.

We claim:

1. A method for transferring a fluid from a source of fluid or of effluents to a point of destination in a single pipe, this fluid containing at least a liquid phase and at least a gaseous phase, the composition of the fluid at any time being expressed by the value of the volumetric ratio GLR of the gas phase to the liquid phase, by using pumping means (P, 8) adapted for communicating to the fluid a sufficient pressure for providing its transfer to a point of destination as long as the GLR value is less than a predetermined threshold value, and compression means (CP, 5), comprising:

determining the GLR value of the fluid, diverting a fraction at least of the gas phase towards said compression means (CP, 5) so as to communicate to said fraction a sufficient pressure necessary to its transfer, as long as the value of the volumetric ratio GLR is greater than said threshold value ($V_s$), and recombining the near total of the suitably compressed gas phase with the fluid coming from the pumping means (P, 8) and conveying the whole consisting of the gaseous phase and of the fluid through a single pipe towards said point of destination, the whole of the recombined fluid containing at least a gaseous part.

2. A method as claimed in claim 1, wherein, for a fluid having a GLR value ranging between the threshold value ($V_s$) and a safety value ($V_r$), a fraction at least of the gaseous phase is diverted through the compression means as long as the GLR value lies outside an interval ranging around the safety value ($V_r$).

3. A method as claimed in claim 1, wherein a compressor is used to raise the pressure of the gaseous phase, and this compressor is started up according to the measured GLR value.

4. A method as claimed in claim 1, wherein a multiphase type pump adapted for raising the pressure of said fluid having a GLR value less than the threshold value ($V_s$) is used and its start-up is controlled from the measured GLR value.

5. A method as claimed in claim 4, wherein the rotating speed of the pump is changed according to the GLR value determined at the pump inlet.

6. A method as claimed in claim 1, comprising using a device for separating the fluid into several fractions delivering thereby to the pumping means a fluid having a more or less constant or substantially zero controlled GLR value said device for separating the fluid being provided with means for measuring the level of the liquid-gas interface.

7. A method as claimed in claim 6, wherein the compressor is started up according to the measured GLR value and at least a fraction of the gaseous phase is discharged through the compression means as long as the level of the liquid-gas interface is below a threshold level value ($N_s$).

8. A method as claimed in claim 7, wherein, when the measured GLR value ranges between the threshold value ($V_s$) and a safety value ($V_r$), the gaseous phase is discharged from the fluid through the compression means as long as the level of the liquid-gas interface lies outside an interval defined around the value of the safety level ($N_r$).

9. A method as claimed in claim 6, wherein the rotating speed of the pump is adjusted for the transfer of a fluid whose GLR value at the inlet of said pump is more or less equal to the GLR value set by said device, or substantially zero.

10. A device for transferring a fluid from a source of fluid or of effluents to a point of destination in a single pipe, this fluid containing at least a liquid phase and at least a gaseous phase, the composition of the fluid at any time being expressed by the value of the volumetric ratio GLR of the gaseous phase to the liquid phase, including pumping means (8) adapted for communicating to said fluid a sufficient pressure for its transfer to a point of destination as long as the value of the volumetric ratio is less than a predetermined threshold value ($V_s$), means (1) for orienting and for separating the fluid according to its GLR value, including at least two discharge lines (3, 6), one for diverting part of the gaseous fraction of the fluid (3) and the second (6) for diverting part of the fluid whose GLR value is controlled, characterized in that it comprises in combination:

means (D) for measuring the GLR value of the fluid, compression means (CP, 5) connected to one of the discharge lines (3) of orienting means (1), adapted for communicating to at least part of the gaseous fraction a sufficient pressure for transferring it as long as the GLR value of the fluid is greater than the threshold value, and a device connected to the pumping means (P, 8) and to the compression means (CP, 5) for recombining the near total of the suitably compressed gaseous phase with the fluid coming from the pumping means, with no complete dissolution of a phase in the other, the mixture produced thereby being transferred through a single pipe (10) towards said point of destination (T), said mixture containing at least a gas phase.

11. A device as claimed in claim 10, wherein the pumping means (8) include at least one multiphase pump.

12. A device as claimed in claim 10, wherein the compression means (5) for compressing the gaseous phase include a compressor.

13. A device as claimed in claim 10, wherein the means (1) for orienting and for separating the fluid according to its GLR value include a tank (11) crossed by a first tube (14) pierced with a plurality of ports located in its upper part and a second concentric tube (16) located outside the first tube, pierced with a plurality of ports located in its lower part, the height of the second tube being less than the height of the first tube.

14. A device as claimed in claim 13, wherein the tank is provided with a level detector (21) for measuring the level of the liquid-gas interface.

15. A device as claimed in claim 12, comprising means for adjusting the rotating speed of the pump.

16. Application of the method as claimed in claim 1 to the transfer of a multiphase petroleum effluent containing at least a liquid phase and at least a gaseous phase.

17. Application of the method as claimed in claim 1 to the transfer of a petroleum effluent mainly containing a gaseous phase.

* * * * *